US005979604A

United States Patent [19]

Pinna et al.

[11] Patent Number: 5,979,604

[45] Date of Patent: Nov. 9, 1999

[54] EQUIPMENT FOR THE AUTOMATION OF CATERING, BAR OR OTHER PRODUCTS OF GOODS SALES SERVICES

[75] Inventors: Genesia Pinna, Chiasso, Switzerland; Roberto Monfasani, Zola Predosa, Italy

[73] Assignee: Genesia Pinna, Chiasso, Switzerland

[21] Appl. No.: 08/952,592

[22] PCT Filed: May 15, 1996

[86] PCT No.: PCT/IB96/00458

§ 371 Date: Nov. 24, 1997

§ 102(e) Date: Nov. 24, 1997

[87] PCT Pub. No.: WO96/37857

PCT Pub. Date: Nov. 28, 1996

[30] Foreign Application Priority Data

May 26, 1995 [IT] Italy ..... BO95A0262

[51] Int. Cl.[6] ..... E04H 3/04

[52] U.S. Cl. ..... 186/39; 186/50

[58] Field of Search ..... 186/49, 50, 39, 186/38, 41; 340/573, 541; 379/215, 171, 172, 173

[56] References Cited

U.S. PATENT DOCUMENTS

| | | | |
|---|---|---|---|
| 2,489,732 | 11/1949 | Trimble | 186/50 |
| 2,640,581 | 6/1953 | Abitz | 186/49 |
| 4,019,605 | 4/1977 | Kropf . | |
| 4,071,710 | 1/1978 | Burnett | 379/171 |
| 4,553,222 | 11/1985 | Kurland et al. | 186/38 |
| 4,582,172 | 4/1986 | Takeuchi et al. | 186/38 |
| 4,675,515 | 6/1987 | Lucero | 186/41 |
| 4,722,053 | 1/1988 | Dubno et al. | 186/38 |
| 4,899,666 | 2/1990 | Meier . | |
| 5,113,970 | 5/1992 | Bavis . | |
| 5,128,862 | 7/1992 | Mueller . | |
| 5,280,266 | 1/1994 | Kao | 340/541 |

*Primary Examiner*—Christopher P. Ellis
*Assistant Examiner*—Bryan Jaketic
*Attorney, Agent, or Firm*—Venable; George H. Spencer; Allen Wood

[57] ABSTRACT

Serving lines (1) have ends that extend into a kitchen (2). At the sides of the serving lines (1) are seats (12), shelves (11), distribution ports sealed off with flaps (10), and equipment for remote ordering. Orders are transmitted to the kitchen (2), which is equipped with a terminal (8) and a printer (9). An order is prepared and placed, with the bill, on a tray (18) that is deposited at the end of a serving line, which automatically transports the tray to the position of the customer who originated the order. A flap (10) then opens temporarily for the tray to be removed. After eating, the customer goes to a till, presents the bill, pays and leaves. A processor monitors automatic operation of the system; it is linked to the till for the appropriate checks. Special serving lines are also proposed to which customers with prepaid cards have access, offering such customers remote payment services as well.

10 Claims, 5 Drawing Sheets

EQUIPMENT FOR THE AUTOMATION OF CATERING, BAR OR OTHER PRODUCTS OF GOODS SALES SERVICES

BACKGROUND OF THE INVENTION

The invention concerns equipment for the automation of catering, bar or other products or goods sales services, which has been designed to appreciably increase productivity in serving and to meet the following customer requirements for catering or bar services for example to enter the premises and immediately find somewhere to sit, without having to wait and join long queues by the till, such as is the case at present with self-service and fast food restaurants; to find someone to take the order immediately; to receive the items ordered in a relatively short time; to be able to manage the waiting time freely and to the optimum extent; to have a public information and remote service facility, also providing a bar and catering service; and finally, to be able to leave the restaurant avoiding long queues at the till.

SUMMARY OF THE INVENTION

Basically the equipment as per the invention consists of a tunnel that is generally in a straight line, with the entry to the restaurant at one end where the service staff are posted, such as the kitchen for example, and with a longitudinal conveyor with lateral flaps opposite and lateral horizontal shelves, served by comfortable seats for the customers who can access the line directly, without waiting at the till.

In the most simplified form, opposite each seat on the side wall of the tunnel there is a call button and an intercom or equivalent means with which the customer can communicate with a central operator who takes the orders and inputs them in the system by PC.

There is no reason why, as an alternative to or in combination with the intercom, there should not be a function key which identifies each seat by a code and with which the customer can input the order into the system automatically, identifying each dish with a code which appears on the menu displayed, for example, on an illuminated board affixed to the wall of the service bay. The tunnel projects slightly above the shelves to act as a table, so that those seated on either side of the tunnel can see each other and converse.

Special serving lines are also envisaged in which a terminal is provided at each position arranged laterally in relation to the tunnel, to read and write discount or subscription cards which the customer can purchase at the entrance to the restaurant or from any other authorized center and on the tunnel there is a PC with associated keyboard and mouse at each position. The customer on this line can use the PC to obtain more details on the menu and to place his order remotely, and while waiting for the items he has ordered, the customer can use the PC for different types of service for which the equipment is designed.

In the kitchen at the end of each serving line, there is a PC with keyboard and mouse and a printer. The VDU of this PC displays the various line orders in chronological order. The operator concerned prepares and places on a tray what the customer has ordered, together with any items necessary for their consumption, and with the bill produced by the printer, and then places the tray at this end of the tunnel conveyor and by activating a control, actuates the conveyor in the direction of the customer. Controlled by sensors and a simple automated system, the conveyor stops with the tray opposite the seat for which it is intended and the side flap on the tunnel opens automatically beside the customer who placed the order, and he then removes the tray after which the flap closes automatically and the kitchen operator can repeat the procedure described to serve the various customers on that line. After finishing the meal, the customer can leave the restaurant by passing via the till where he presents the bill for payment. Customers on lines with PC's who have discount or subscription cards on which the cost of the service used is automatically debited can pass through a quick check at a dedicated till or can leave the restaurant without waiting at the till, by means of a gate which opens automatically using the same card.

DESCRIPTION OF THE PREFERRED EMBODIMENT

Figure 1:
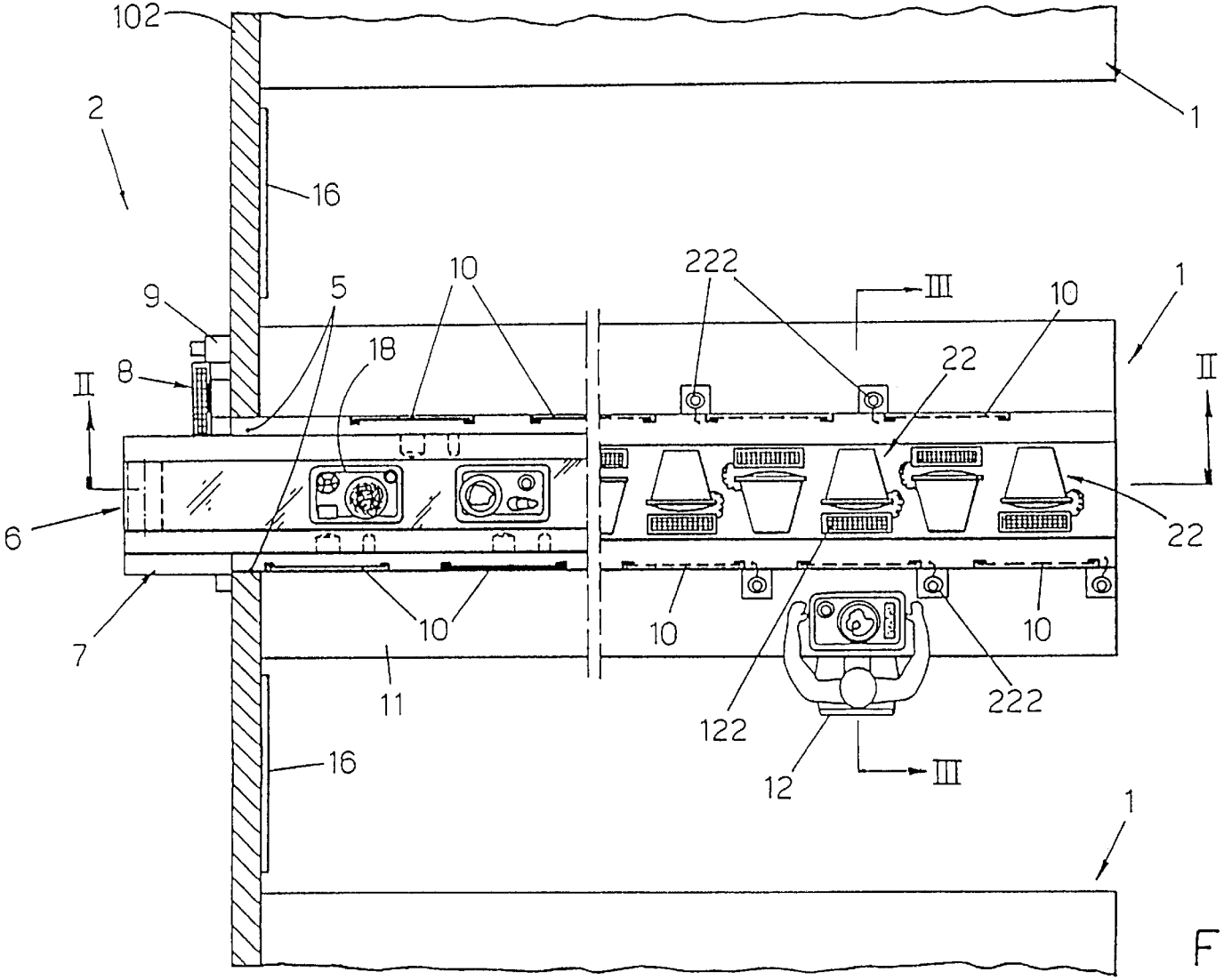
FIG. 1 is a plan view from the top and sections of the equipment as per the invention.
Figure 2:
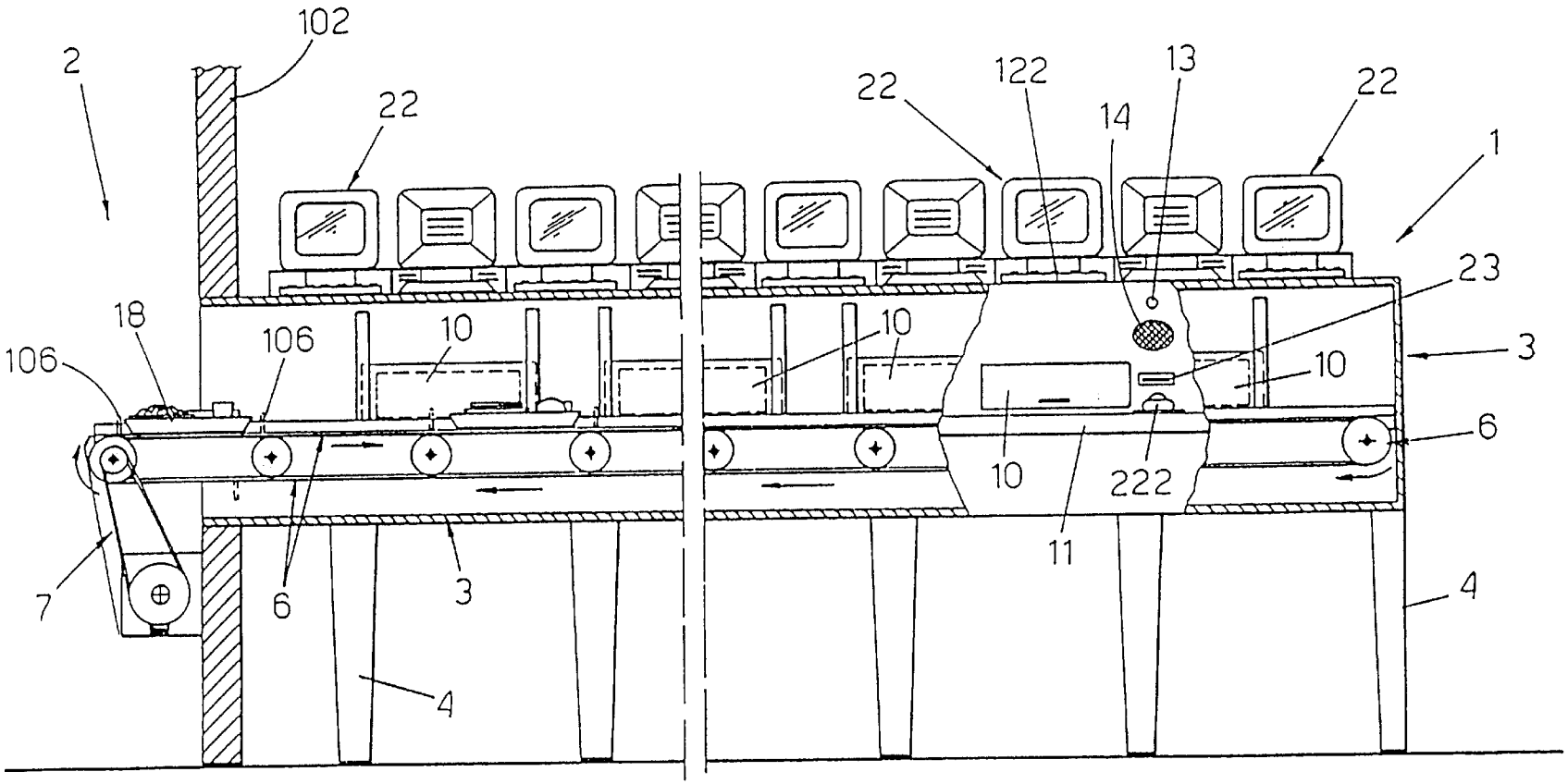
FIG. 2 shows further details of the serving line shown in FIG. 1, with parts in lateral elevation and a section along line II—II.
Figure 3:
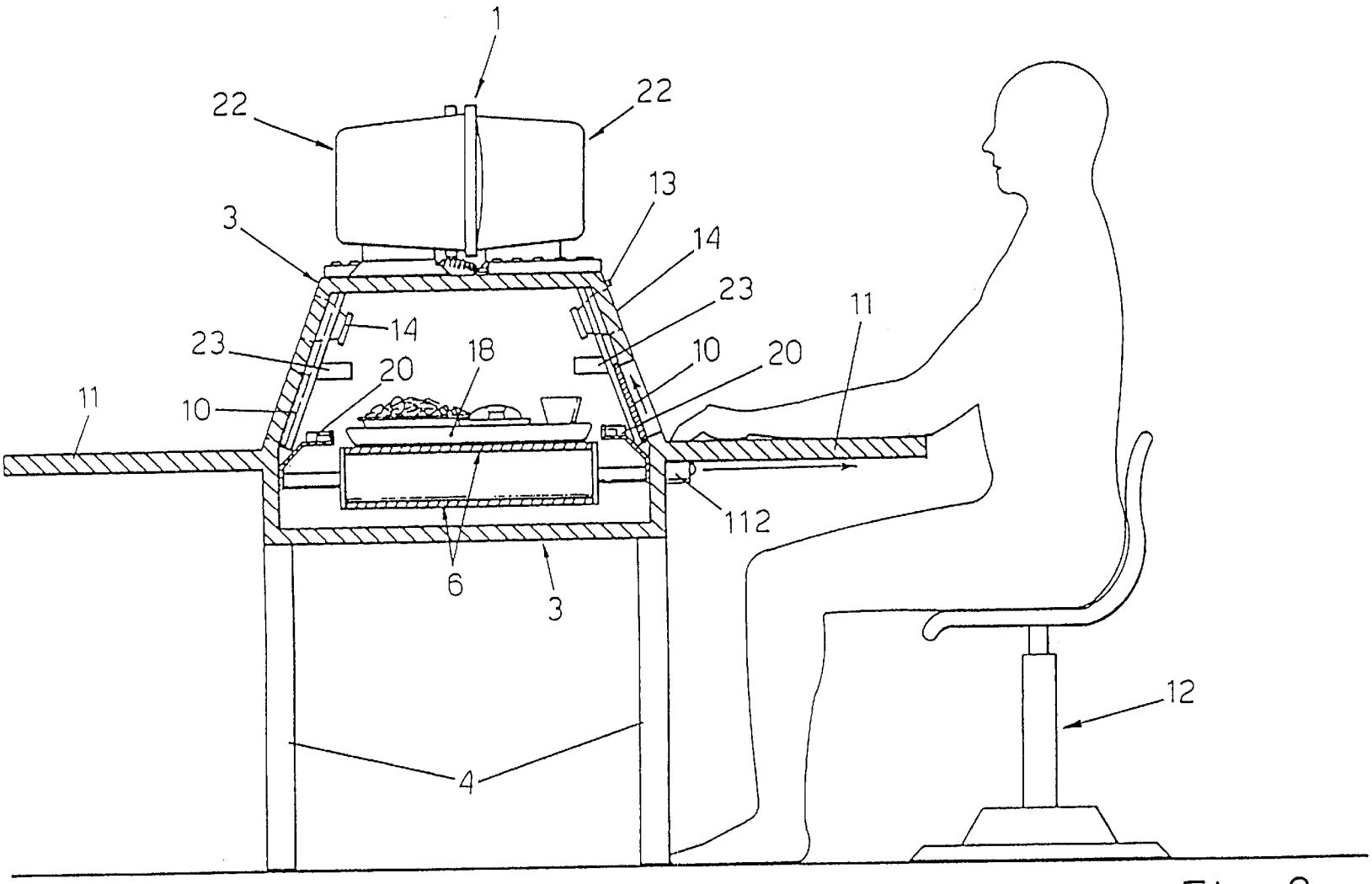
FIG. 3 shows details of a seat position on the line in FIG. 1, seen along section line III—III.

With reference firstly to FIGS. 1, 2 and 3, it will be seen that the equipment comprises several serving lines of any appropriate length, positioned alongside each other at an appropriate reciprocal distance apart, terminating at one end at a wall of the restaurant, for example a wall 102 of a kitchen 2, where the serving personnel operate.

The lines 1 are preferably straight lines, but to meet special requirements, they may be structured differently. For preference, these serving lines 1 are modular in type and can be combined to facilitate the construction of assemblies of the required length.

Each line comprises a horizontal tunnel 3, of appropriate section, maintained at the correct distance from the floor by supports 4 and with one end open ending at a window 5 in the wall 102 of the kitchen, whilst the other end is sealed. The lower part of the tunnel 3 is occupied longitudinally by a form of conveyor 6, for example a belt or strap conveyor and equipped where necessary with equidistant transverse fins 106 forming small bays suitable for holding a tray, as described below.

The conveyor 6 projects for an appropriate distance inside the kitchen 2 where it is linked to an appropriate means of motorization 7 in a suitable housing. This means may consist of a motor with electronic speed and phase control, with an associated tachometer unit and brake, connected to the conveyor 6 by a belt drive and toothed pulley.

In the kitchen 2 opposite each serving line 1 is a PC 8 and a printer 9, which are described below.

The tunnel 3 is equipped laterally on each side with equidistant windows, positioned above the conveyor 6 and normally sealed off with flaps 10 that open automatically. This same tunnel 3 is equipped laterally on both sides with horizontal projecting shelves 11, positioned beneath the said flaps 10 and of a height suitable to fulfill the function of a table for customers who can be comfortably seated on the seats 12, with at least one seat opposite each flap. Opposite each seat or position, the following may be provided: a sensor 112, for example optoelectronic in type, which automatically signals that there is a customer present; a call button 13 and an intercom 14 or an equivalent means, for example, a telephone with mobile micro-telephone, with which a customer freely entering a restaurant using the equipment described takes a seat or similar 12, and can then call a central exchange shown as 15 in FIG. 4, where the order can be placed, selecting from the menu which may be displayed in any appropriate form, for example on an illuminated board 16 fixed to the wall 102, facing the serving line 1. The central exchange 15 is served by an operator who takes the various orders in person. If the operator of the central exchange 15 is busy, an automated system takes over which advises the customer via the intercom that it is not possible to connect him and that he will be called back as soon as possible, and waiting music can be played. Each button 13 and/or each sensor 112 will have its own code and the operator of the central exchange 15 will have a known means enabling him to call back the position which asked for a connection. As soon as it becomes possible, the customer places the order by means of the intercom and the operator of the central exchange 15 inputs the order remotely into the CPU 17 which handles automatic operation of the entire system, as described below. According to a minor variant in construction, the central exchange 15 may be equipped with a telephone message service that automatically takes the different orders which are then extracted and prepared by the operator concerned.

As an alternative to or in combination with the presence of parts 13 and 14 mentioned above, a small function keyboard, not shown, can be provided at each position, with which the customer can directly input his own order remotely into the CPU 17, using reference codes identifying each course as displayed on the menu.

In this case, the intercom 13/14 can be used to advise the customer how to use the said function keyboard.

The CPU 17 is also connected to the units 8/9 on each serving line and advises the kitchen of the orders received in chronological order, and if necessary also arranged according to the time needed for preparation.

The kitchen can be organized completely automatically, by means of distributors, conveyors, robots and/or other systems, or in semi-automatic or manual form. In the latter cases, the kitchen operator prepares the customer's order on an associated tray 18 together with the receipt produced on the printer 9, then places the tray at the starting end of the conveyor 6 and sets it on its way with selective controls provided for example on the PC 8, which identify the position to which the tray is to be sent. A unit 19 is provided to control operation of the conveyor 6 and the associated motor-drive 7, which may be intelligent type as described, so that the tray 18 conveyed in each case stops exactly opposite the flap 10 by the customer for which it is intended.

To this effect, there is no reason why there should not be at least one sensor 20 in the tunnel 3 opposite each flap 10 to detect the presence of the tray, this sensor being activated selectively by controls in the kitchen bay, this being of an intuitive design and easily achievable by engineers in the sector. When the tray reaches its destination, the flap 10 at the position concerned opens automatically, and a message can be transmitted automatically to the customer via the intercom, asking him to remove the tray with the order and the bill. In a different solution, a means can also be provided that automatically ejects the tray from the conveyor, placing it on a small straight shelf at the side, positioned outside the tunnel 3 and not shown in the. drawings, from which the customer can remove it when he chooses. When the tray has been removed from the tunnel, the flap 10 closes again automatically, enabling the conveyor 6 to be used again.

The customer can place more than one order, and will receive a bill for each.

When the customer has finished his order or orders, he can leave the restaurant by passing via the till 21 which, due to the circuit link with the seat 12 and the CPU 17, knows what has been ordered at each position and is able to make the necessary checks and subsequently update the equipment memories. The customer presents his bill or bills at the till 21, pays the bill in cash or with a credit or debit card or any other form of electronic funds transfer and can then leave.

The line described is a simple serving line to which those wishing to converse can also have access and who can sit on one or both sides of the serving line. The tunnel 3 is restricted in height and as such enables those seated on opposite sides of a line to see each other and converse.

Both simple and special serving lines can be provided in one and the same restaurant, of the type shown in the drawings, which are also able to offer a remote payment service. In these lines, the flaps 10 on one side are offset one step in relation to those opposite (FIG. 1) and on tunnel 3 a PC 22 is provided for each flap 10, with an associated keyboard 122 and on the shelves 11 there is a mouse 222 for each PC. The PCs 22 are offset on one side in relation to the other and can if necessary be equipped with separating barriers, not shown, so that customers positioned on one side of a special line cannot see customers on the opposite side and are not disturbed by the customers next to them. At the sides of the tunnel 3, there is a terminal 23 for each position for reading and writing a discount or subscription card, which the customer can purchase at the entrance to the restaurant or from an authorized center. Each PC 22 can be linked by means of the CPU 17 to an internal remote service unit 24 (FIG. 4) or by means of a modem 25 to an external remote service unit.

After sitting down at his selected seat, the customer on the special serving line introduces his own card in terminal 23 and can place an order by the same means as the simple line or, more advantageously, via the keyboard on his own PC 22 which will input the order directly into the CPU 17, whilst this same PC 22 can give useful detailed information on its use and the menu. Once the order has been placed and whilst waiting for the tray to arrive as described above for the simple serving line, the customer on the special serving line can use the PC for various purposes for which it is designed, for example, for playing video games, or to access internal or external data base(s), for example for connection to the <Internet>.

The CPU 17 controls the use of each PC 22 and updates the associated account to be debited to the card introduced into the associated terminal 23. The cost of any order placed with the kitchen can also be debited to the card automatically. At the end of the service, the customer on the special line withdraws his card from the terminal 23 and can leave the restaurant by passing through a fast-track till 121 which makes a check against the information on the CPU 17, or by passing through an automatic gate of known type, not shown, to replace or supplement the till 121 which can be used if the terminal at the automatic gate finds discrepancies. In each case any errors can be cleared up by a closed circuit television recording system.

Figure 4:
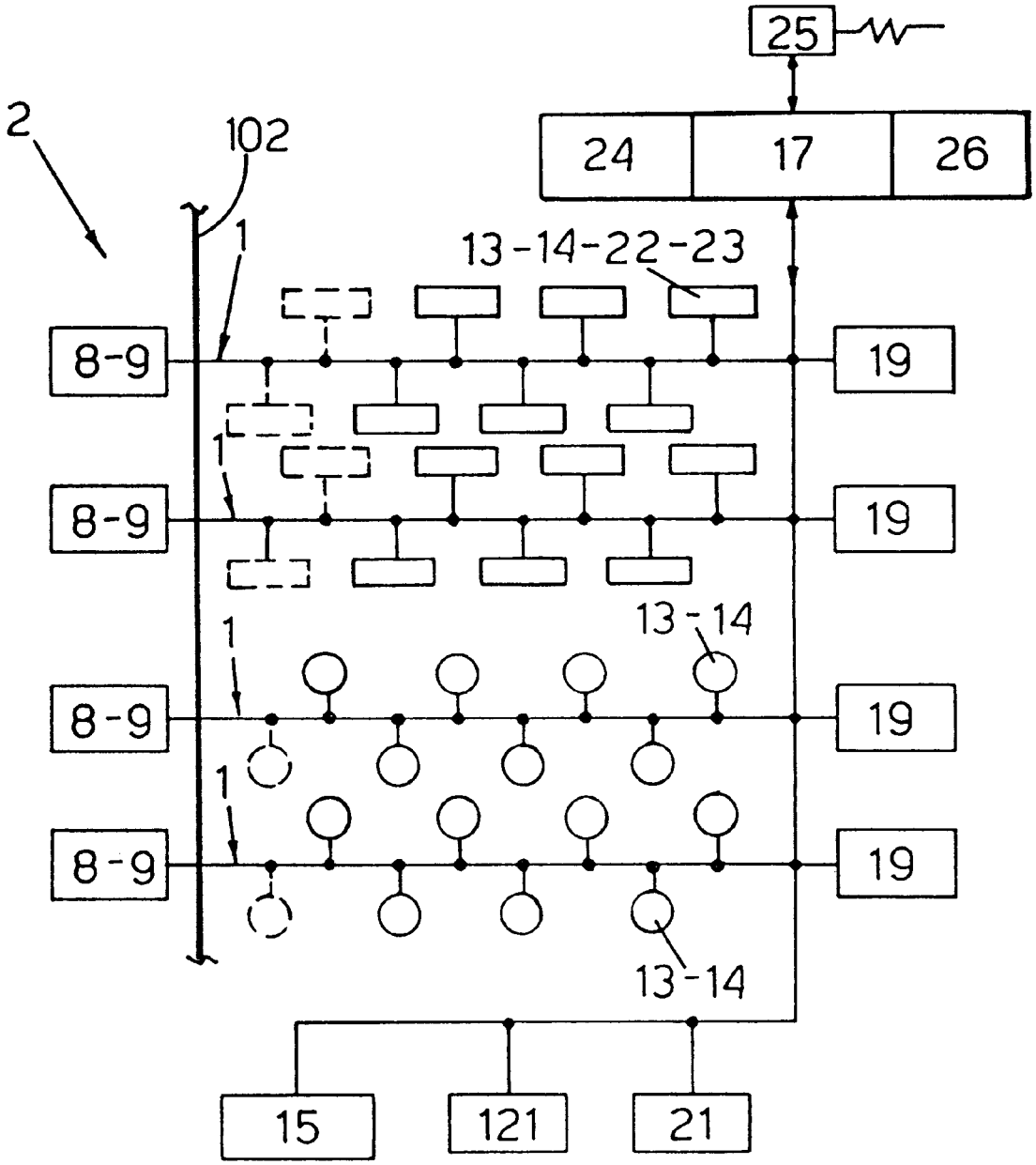
FIG. 4 illustrates a block wiring diagram of the equipment.

It can be seen from FIG. 4 that the CPU 17 is also linked to an internal database 26, which is useful for automated control of the restaurant, for example, with regard to accounting, stores, the presence or absence of personnel, and/or for statistical or registration purposes and/or other purposes.

Figure 5:
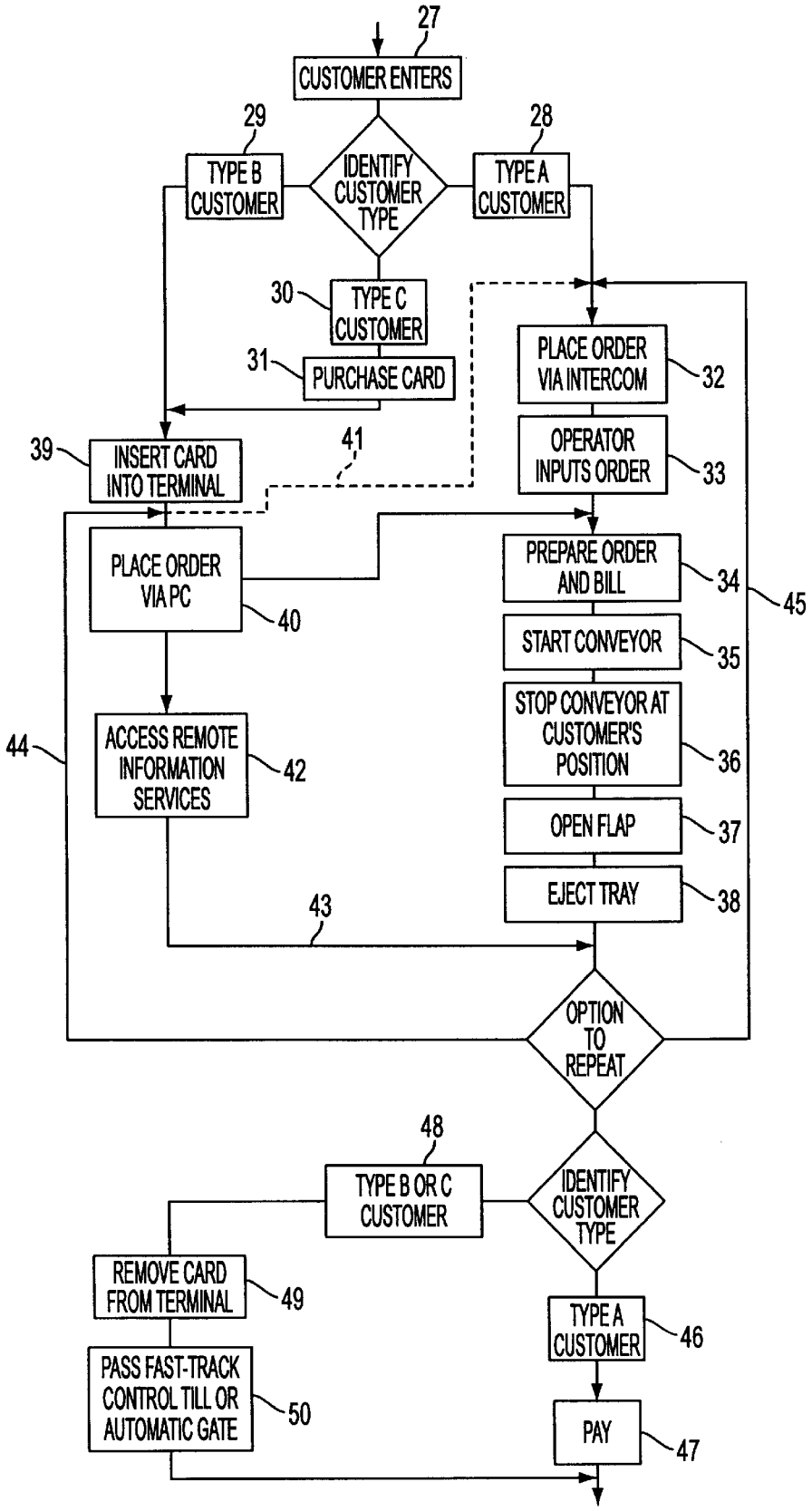
FIG. 5 is a flowchart showing the various operating phases of the equipment.

FIG. 5 shows a possible flowchart of the operating phases of the equipment. Reference 27 is the customer entering, who may be a "type A" customer (reference number 28) destined for a simple serving line, or a "type B" customer (reference number 29) destined for a special serving line and already in possession of the discount or subscription card, or a "type C" customer (reference number 30) again destined for special lines but not holding a card and who purchases one at phase 31. Customers on the simple line place their orders by intercom 32 which are then input into the automated system by the central exchange operator in phase 33.

This phase is followed by phase 34 which is preparation of the order and placement of the bill on the tray by the kitchen operators, phase 35 is start-up of the conveyor which transports the tray from the kitchen to the position for which it is intended, and then phase 36 entails control of the tray's routing, stopping it opposite the correct position, and finally phase 37 when the flap opens at the appointed position and phase 38 ejects the tray with the ticket therefrom the and subsequent closure of the flap.

The customers 29 and 30 on the special line insert their card in the appropriate terminal at the selected position, referenced 39, and can then place an order with the meal service remotely via their PC as indicated by phase 40, or by means of the intercom, indicated by connection 41. After placing an order with the meal service, customers on the special serving lines can access the remote information services, as indicated by 42. If an order has been placed with the meal service, the sequence of operating phases for customers on the special serving lines is 34, 35, 36, 37 and 38 as already described for customers on the simple serving lines. Link 43 shows that a customer on the special serving lines need not necessarily place an order with the meal service and may just use the PC and the services for which this equipment is designed. Links 44 and 45 indicate that both the customers on the special serving lines and those on the normal lines can repeat an order several times.

After the phases concerned, the flow 46 of customers on the simple serving lines (i.e., type A customers), passes by the till with the bill in order to pay, as indicated by 47 and can then leave the restaurant. The flow 48 of customers on the special serving lines (i.e., type B or C customers), after removing the card from the reading and updating terminal, as indicated by 49, passes via the appropriate fast-track control till or via an automatic gate, indicated by 50, and can then leave the restaurant.

The equipment as per the invention clearly enables an appreciable throughput and good quality of automatic service.

It is of course understood that the equipment described can also be used for the automation of services other than catering, for example bar or other product or goods sales services. A similar line can for example be used for the sale of foods, completely revolutionizing the current operating logic of supermarkets and hypermarkets.

It is finally understood that the description refers to a preferred form of construction of the invention, to which numerous variants and modifications can be made, especially in constructional terms. There is no reason why the terminal 23 for reading and writing discount or subscription vouchers, should not also be provided on the simple serving lines, in order to facilitate the service for customers using the subsequent phases for leaving the restaurant. This alternative would then enable pay and view type entertainment services to be provided including via the intercom or telephone 13/14. There is no reason why a small printer should not be provided for a print-out in clear of the relative expenditure for each usage of the discount or subscription card, on the special serving line positions at least, or to issue a bill to replace that previously assumed as being issued in the kitchen. These and any other variants which are moreover known intuitively by engineers in the sector do not go beyong the scope of the invention, as described above, as illustrated and in accordance with the claims below.

In the following claims, the reference numbers shown in brackets are purely indicative and not limitative in terms of protection of these same claims.

We claim:

1. A system for delivering items from an order processing station (2) to a plurality of remote delivery stations (11, 12), each delivery station serving a single customer and being provided with means for remotely ordering items from the processing station, comprising:

(a) at least one serving line (1) capable of serving a plurality of the delivery stations (11, 12), each at least one line (1) being connected directly to the order processing station (2) and including a longitudinal horizontal central conveyor (6) on both sides of which there are provided horizontal shelves (11) serving as tables and seats (12) for the customers, said conveyor (6) being adapted to carry the ordered items and being covered by a tunnel (3) projecting above a level defined by said horizontal shelves (3), said tunnel (3) having opposite sides and being provided on its opposed sides with ports through which items can be withdrawn from the conveyor (6), suitable doors (10) being provided for closing said ports, identification and control means (13, 14) at each delivery station (11, 12) for enabling the order processing station (2) to identify any particular delivery station, and an order by a customer seated at the said particular delivery station, and a terminal at each delivery station to receive a credit or debit card to pay for the order;

(b) display and processing means (8, 9) at the order processing station (2) for displaying orders from each customer and for enabling the processing and carrying out of each separate order, including issuance of a corresponding ticket or bill;

(c) means (19) for controlling the conveyor (6) to ensure that each item placed on the conveyor is conveyed to the desired port of the pertaining delivery station (11, 12) and that the pertaining door (10) can be opened for withdrawal of the item; and (d) a central processing unit (CPU 17) which receives the various order and which automatically controls operation of the whole system, wherein the system is disposed in an establishment having an exit, and further comprises a dedicated counter (121) at the exit for a fast-track control of the card, which is linked to the central processing unit (CPU 17) for performing financial checks.

2. A system according to claim 1, in which the means for remotely ordering provided at each delivery station, includes an intercommunication system (14) with a call button (13), linked to a central exchange (15) where operators receive the orders and input the orders into the central processing unit (CPU 17).

3. A system according to claim 2, in which the central exchange (15) is equipped with a telephone message service for automatic receipt of orders.

4. A system according to claim 1, in which the means for remotely ordering provided at each delivery station includes a function keyboard, whereby the customer can place the order directly to the central processing unit (CPU 17).

5. A system according to claim 1, in which each seat (12) at each delivery station is equipped with a sensor (112) to indicate the arrival of a customer.

6. A system according to claim 1, in which the conveyor (6) of each at least one serving line is a belt conveyor driven by a motor (7) controlled by a control unit (19) which co-operates with sighting sensors (20) positioned in the tunnel (3) at each delivery station to detect and indicate the presence of the ordered item at the required delivery station.

7. A system according to claim 1, in which the terminal (23) for the card can be used by the customer to obtain access to pay-and-view type entertainment services.

8. A system according to claim 1, in which each delivery station equipped with a terminal (23) for a card is further provided with a PC (22) for placing orders directly with the central processing unit (CPU 17) and for access to pay-and-view type entertainment services, the PC (22) serving as the means for remotely ordering.

9. A system according to claim 8, in which the computers are arranged on top of the tunnel (3) so as to face one side or the other side of the serving line alternately and the seats along this serving line are likewise offset on each side so that they are equidistant with a spacing equivalent to twice that between two adjacent PCs.

10. A system according to claim 1, wherein the establishment is a restaurant and the items comprise meals.

* * * * *